United States Patent [19]

Richelle et al.

[11] 3,982,487

[45] Sept. 28, 1976

[54] MICRO-DELAYED DETONATOR FOR BALLISTIC ROCKETS AND ROCKETS THUS EQUIPPED

[75] Inventors: Adelin F. Richelle, Agimont, Belgium; Hans D. Harnau, Koblenz, Germany

[73] Assignee: S.A. Prb. Societe Anonyme, Brussells, Belgium

[22] Filed: June 4, 1974

[21] Appl. No.: 476,206

[30] Foreign Application Priority Data

June 14, 1973 Belgium ..... 800881

[52] U.S. Cl. ..... 102/70 R; 102/85

[51] Int. Cl.[2] ..... F42C 1/00

[58] Field of Search ..... 102/85, 79, 80, 70 R, 102/73, 78, 76 R, 27, 28

[56] References Cited

UNITED STATES PATENTS

| | | | |
|---|---|---|---|
| 1,197,414 | 9/1916 | Watson | 102/79 |
| 3,088,006 | 4/1963 | Kabik et al. | 102/85 |
| 3,162,127 | 12/1964 | Breslow et al. | 102/85 |
| 3,173,364 | 3/1965 | Nordzell | 102/70 R |
| 3,620,163 | 11/1971 | Shekro | 102/76 R |
| 3,712,231 | 1/1973 | Petzsch et al. | 102/79 |
| 3,768,415 | 10/1973 | Czajkowski | 102/79 X |

*Primary Examiner*—Harold Tudor
*Attorney, Agent, or Firm*—Bacon & Thomas

[57] ABSTRACT

The invention pertains to a micro-detonator having a first cap and a second cap associated to a delaying charge. Said caps are respectively located in housings separated by a diaphragm having a striking protrusion to fire the second cap.

1 Claim, 5 Drawing Figures

Fig. 1
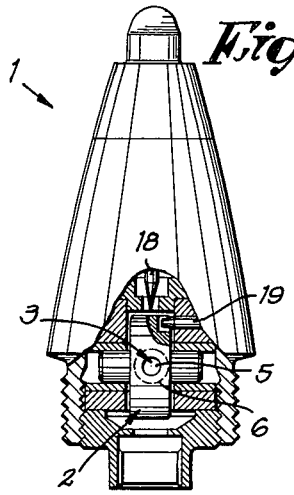
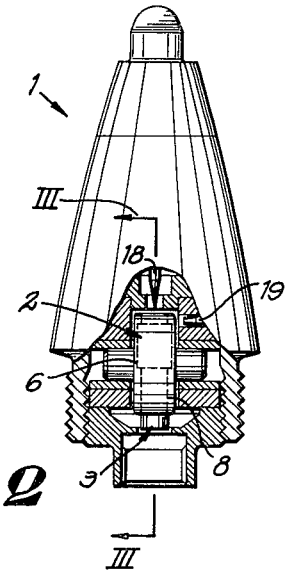
Fig. 2
Fig. 4
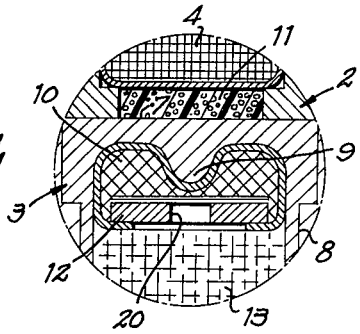
Fig. 3
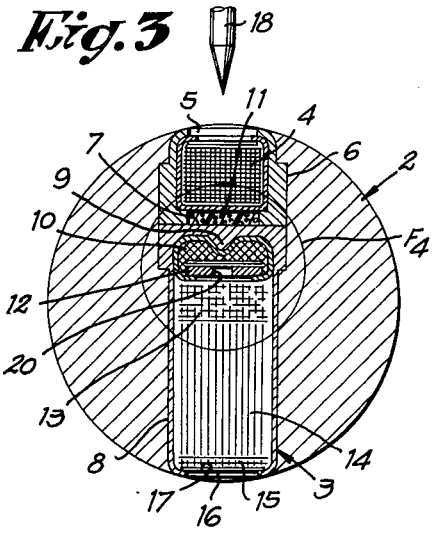
Fig. 5
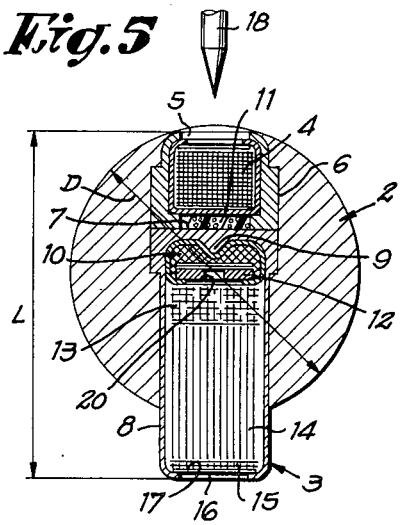

MICRO-DELAYED DETONATOR FOR BALLISTIC ROCKETS AND ROCKETS THUS EQUIPPED

The present invention relates to a microdelayed detonator for ballistic rockets intended for small bore missiles, such for instance as those used in air warfare or for antiaircraft purposes. It extends to the rockets equipped with such a detonator.

In such a field of application, it is most important, from an efficiency viewpoint, that the firing of the explosive charge of the rocket should only take place after a time of some 200 to 320 $\mu$s after the impact with the target, depending upon the nature of the part of the target which has been hit.

In practice it is extremely difficult to fabricate detonators which meet these requirements, subsequent to the miniaturization called for due to the small bore and to the inherent difficulties of large series production.

Up to this day, no truly satisfactory solution has been found to this problem.

Detonators have already been presented which consist, amongst others, of a striker, a head cap, a partition with striking protrusion, a second cap and a delaying charge, whereby the head cap on the one hand, and the second cap with the delayed charge on the other hand, are respectively placed in coaxial and separate housings with no mutual communication. Such housings, in this known device, are fitted in the mass of a rotor, in the shape of two coaxial blind bores. Such detonators do not however lend themselves to miniaturization, due to the fact, amongst others, that they require a relatively large quantity of explosive matter for the head cap.

It has on the other hand also been suggested to place the head cap in an enclosure, inserted in a cavity provided for instance in a rotor, this cavity connecting up by means of channels with a second cavity in which are fitted a second cap and a delayed charge. In such a construction, the volume which remains free in the first cavity as well as in the channels makes up a decompression chamber. The second cap is fired mainly by the fragments of aforesaid enclosure, after the striking of the head cap. Such a solution requires a head cap of relatively large volume. It moreover gives rise to delay times which may vary considerably from one detonator to the next, in the case of the bores under consideration (for instance 30 mm).

The purpose of the present invention is to correct the inconveniences of the known detonators, such as briefly described above. In view thereof a detonator with micro-delay has been suggested for rockets, of the type which comprises at least one striker, a head cap, a partition with a striking protrusion, a second cap and a delaying charge, whereby the head cap on the one hand, and the second cap with delayed charge on the other hand, are respectively fitted in separate coaxial cavities without mutual communication whatever, characterized by the fact that aforesaid cavities are separated the one from the other by a diaphragm with striker protrusion, this remaining sealed during the entire operation, a compensation chamber containing an absorbing body being provided between aforesaid head cap and aforesaid diaphragm with striker protrusion.

The abovementioned constant sealing is obtained by the appropriate dimensioning of the walls and of aforesaid diaphragm in accordance with the explosive materials used.

The sealed operation assures an optimum use of the head cap energy, the volume of the head cap being necessarily quite small.

Aforesaid compensation chamber plays an essential part. It is indeed the compression of the absorbing body it contains which, subsequent to the setting off by the head cap, assures the distortion of aforesaid diaphragm, and subsequently the firing of the second cap. In this manner, this chamber permits a compensation of the inevitable quantitative differences of the head caps which occur in series production. In order better to stress the characteristics and advantages of the invention, the latter is described in greater detail hereinafter, with reference to the illustrating and nonlimiting appended drawings in which:

FIG. 1 shows a front view with partial section of a rocket fitted with a delayed detonator according to the invention, the rocket being shown in its state of rest or of safety;

FIG. 2 is similar to FIG. 1, the rocket being shown in its cocked state;

FIG. 3 shows, drawn to larger scale, a section according to line III—III in FIG. 2;

FIG. 4 shows, drawn to larger scale, that part of FIG. 3 indicated by F4; and FIG. 5 shows an alternative form of embodiment of the rotor of the rocket shown in FIGS. 1 to 3.

In the appended drawings, the rocket is shown as 1, the rotor of the rocket being shown as 2 and the detonator as 3. Rocket 1 and rotor 2 are mainly of an average type of which certain forms of embodiment are known. The delayed detonator consists mainly of a link in the pyrotechnical chain assembly of the missile. In the present case this link consists of a head cap 4 of which the top wall 5 offers a relatively small resistance. This cap 4 with its wall 5 is fitted in container 6 which has a very large lateral resistance. A diaphragm 7 forms the upper reinforced part of a casing 8. This diaphragm 7 has an inwardly directed protrusion 9 of hemispherical shape which acts as striker for the second cap 10. The peripheral edge of diaphragm 7 has an excess thickness with regards to the thickness of casing 8.

According to one of the main characteristics of the invention, a compensation chamber filled with an elastic cellular material 11 is provided between head cap 4 and diaphragm 7, being laterally bounded by the corresponding part of container 6. The second cap 10 comprises an annular support 12, the remainder of casing 8 being filled successively by a delay mixture 13, a setting off explosive charge 14 and a secondary charge 15. The bottom of casing 8 has a wide opening 16 which is closed by a wall 17 of relatively small resistance. Aforesaid compensation chamber is filled with an absorbing substance, which may be air (as shown), felt, some elastic material such as natural or synthetic rubber, a product of cellular structure, etc. . . .

In the rocket shown, striker 18 is of the suspended type, although it might be replaced by any other firing means. Rotor 2 is normally immobilized, in the well known manner, by a schematically shown safety device, in the present case a bolt 19.

It will be seen that the head cap 4 is a tight fit in container 6 which, as previously explained, must be very sturdy in order to assure the perfect sealing of the system and to promote the propagation of the shock wave in the required direction, i.e. towards diaphragm 7. It is indeed most important to be able to avail of the entire power developed by the explosion of head cap 4 in order to set off the second cap 10, considering that the quantity of explosive materials used for aforesaid head cap 4 is very small. This setting off is effected by the distortion of diaphragm 7 of casing 8, distortion obtained by the compression of the absorbing substance contained in chamber 11 due to the action of aforesaid head cap 4. This compensation chamber 11 is essential in the present case due to the fact that when percussion takes place, the second cap 10 must be set off squarely, whereas diaphragm 7 may not fail when aforesaid head cap 4 is fired. This setting off of cap 10 is obtained by pinching the explosive between the spherical shape at the bottom of the central hollow of aforesaid cap 10 and the upper edge 20 which bounds the central hole of support 12.

Aforesaid support 12 shall have a good resistance so that the flame can be directed and concentrated towards its center and that it may serve with efficiency as support wall during the action of internal striker 9 which is an integral part of diaphragm 7. This flame then ignites delay mixture 13, which itself will fire the setting off explosive charge 14, which in its turn will set off the secondary charge 15. Aforesaid setting off explosive charge 14 may for instance consist of lead nitride.

Aforesaid secondary charge 15 shall be sufficient to give the required output impulse to fire the remainder of the pyrotechnical train which, being known in itself, is neither shown nor described here.

The crimping of bottom 17 by the peripheral adjacent edge of casing 8 must be particularly well performed and sturdy so as to assure a sealed combustion in aforesaid casing.

In the alternative form of embodiment of FIG. 5, the diameter D of rotor 2 has been reduced so as to be smaller than the length L of detonator 3, so as to obtain a part which protrudes from casing 8. The ratio L/D could be of the order of 6/5. By this arrangement, the secondary explosive charge is not contained solely in the rotor. Consequently, should there be an inadvertent operation in the safety phase, the damage caused to the parts located nearby will be restricted to acceptable proportions, for the sake of safety.

The main characteristics revealed in the present description can of course be applied in various forms, without going beyond the scope of the present invention.

What I claim is:

1. A delay train for a rocket, comprising:

a body having a continuous bore therethrough;

a first housing in said bore enclosing a primary primer;

striking means to fire said primary primer upon impact of said rocket;

a second housing in said bore enclosing a secondary primer seated on a support therein and having a wall closing said bore between said first housing and secondary primer, said wall defining with said first housing a closed delay chamber therebetween;

an anvil on the inside of said wall directed toward said secondary primer; and pressure absorbing material in said delay chamber, said pressure absorbing material being an elastic material having a cellular structure.

* * * * *